US005145271A

United States Patent [19]

Sugino

[11] Patent Number: 5,145,271

[45] Date of Patent: Sep. 8, 1992

[54] SERIAL PRINTER

[75] Inventor: Koichi Sugino, Tokyo, Japan

[73] Assignee: Seikosha Co., Ltd., Tokyo, Japan

[21] Appl. No.: 717,441

[22] Filed: Jun. 19, 1991

[30] Foreign Application Priority Data

Jun. 29, 1990 [JP] Japan ..... 2-171633

[51] Int. Cl.[5] ..... B41J 29/42; B41J 25/304

[52] U.S. Cl. ..... 400/711; 400/320; 400/703; 400/61; 400/356

[58] Field of Search ..... 400/703, 711, 320, 322, 400/279, 61, 352, 356, 477, 705

[56] References Cited

U.S. PATENT DOCUMENTS

| | | | |
|---|---|---|---|
| 3,838,250 | 9/1974 | Naas et al. | 400/705 |
| 4,722,621 | 2/1988 | Johnson | 400/472 |
| 4,838,717 | 7/1989 | Ogura | 400/322 |
| 4,846,597 | 7/1989 | Bryant et al. | 400/472 |
| 4,856,924 | 8/1989 | Sugino | 400/703 |

FOREIGN PATENT DOCUMENTS

| | | | |
|---|---|---|---|
| 144188 | 11/1980 | Japan | 400/703 |

*Primary Examiner*—Edgar S. Burr
*Assistant Examiner*—Joseph R. Keating
*Attorney, Agent, or Firm*—Jordan and Hamburg

[57] ABSTRACT

A serial printer includes: a carrier mounted with a printing head; a display means movable with the carrier; a stationary panel having indicating windows arranged so that the display means is recognizable through the specific indicating window when the carrier comes to a predetermined position; a carrying means for carrying the carrier; a printing mode storage means for storing printing modes; an operating switch for selecting the printing modes; and a printing mode setting means for permitting the carrying means to move the carrier and changing the printing mode of the printing mode storage means according to the position of the carrier.

16 Claims, 4 Drawing Sheets

SERIAL PRINTER

BACKGROUND OF THE INVENTION

1. Field of the Invention

The present invention relates to a serial printer capable of appropriately setting modes such as character pitches, font styles and so on.

2. Description of the Prior Art

A typical conventional method of setting modes such as character pitches, font styles and the like in a serial printer involves a combination of an operating switch and LEDs (Light Emitting Diodes). The following is an arrangement of this method. Prepared are, for instance, a character pitch changeover switch and a plurality of LEDs corresponding to respective character pitches. Only one LED is invariably lit up. Every time the character pitch changeover switch is depressed, the LEDs which are sequentially lit up are changed over. The character pitch corresponding to the LED which is being lit up is set. In this method, however, the number of LEDs needed corresponds exactly to the number of items to be set. A goodly number of LEDs are used. The LEDs, the drive circuits thereof, the wire arrangement for them and output ports are costly.

To obviate such a problem, the present applicant submitted Japanese Patent Laid-Open No. 3982/1988. For instance, set printing modes such as character pitches and the like are given in a plurality of moving positions of a printing head of a paper presser bar facing the printing head. The printing head is moved to the position by the operating switch, thus setting the printing mode.

The following drawbacks arise to the above-mentioned method of setting the character pitches by moving the printing head. The operating switch is spaced far away from the printing head for displaying the content (mode) to be selected. This results in a large movement of the visual line of the operator, which causes difficulty in operation. The moving quantity of the printing head is also large. In this respect, the movement of the visual line increases, resulting in difficulty in operation.

SUMMARY OF THE INVENTION

The present invention aims at facilitating the operation by reducing the movement of the visual line of the operator when setting a printing mode while providing for a display means for displaying a selected content close to an operating switch.

To accomplish the foregoing object, according to one aspect of the invention, there is provided a serial printer comprising: a carrier mounted with a printing head; a display means movable integrally with the carrier; a stationary panel formed with a plurality of indicating windows arranged in a plurality of lines in the moving direction of the carrier so that the display means is recognizable through the specific indicating window when the carrier comes to a predetermined position; a carrying means for carrying the carrier; a printing mode storage means for storing printing modes; an operating switch for selecting the printing modes; and a printing mode setting means for causing the carrying means to selectively move the carrier to the predetermined position by use of the operating switch and changing the printing mode stored in the printing mode storage means in accordance with the moving position of the carrier.

According to the present invention, the display means moves under the stationary panel. When setting the printing mode, the carrier is selectively moved to a predetermined position. At this time, the display means is visible to the user of the printer through the indicating window in a position corresponding to the carrier position on the stationary panel. The printing mode to be selected is thereby displayed on the stationary panel. As a result, a moving quantity of the visual line of the user when setting the printing mode can be reduced. This in turn facilitates the operation.

BRIEF DESCRIPTION OF THE DRAWINGS

Other objects and advantages of the present invention will become apparent during the discussion taken in conjunction with the accompanying drawings which show one embodiment of the present invention.

DETAILED DESCRIPTION OF THE PREFERRED EMBODIMENT

One embodiment of the present invention will hereinafter be described with reference to the accompanying drawings.

Figure 1:
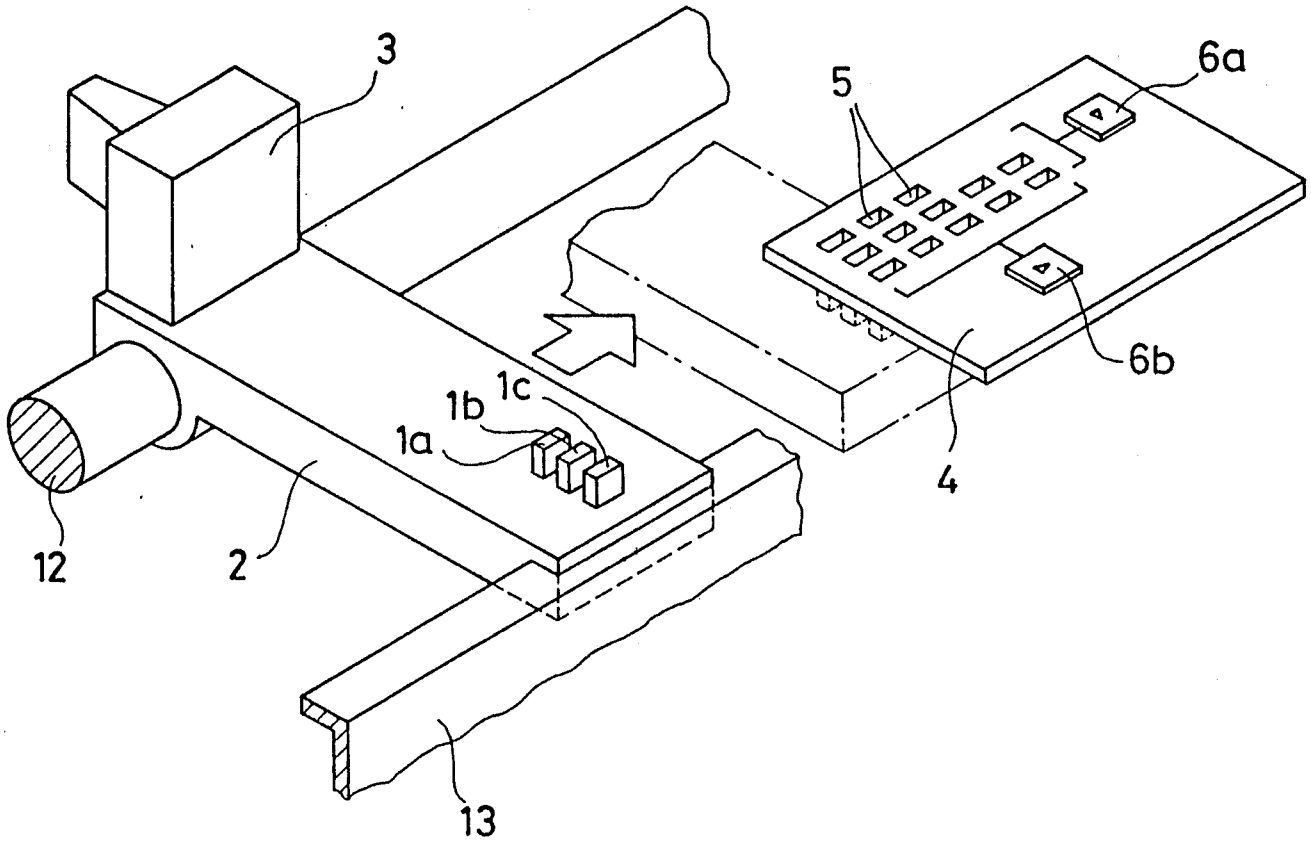
FIG. 1 is a three-dimensional perspective view.

As illustrated in FIG. 1, a carrier 2 is movable to the right and left while being guided by guides 12, 13. The carrier 2 is mounted with a printing head 3 and LEDs (Light Emitting Diodes) 1*a*–1*c* as one embodiment of a display means. A stationary panel 4 is encased in a printer case (not illustrated) so that the carrier 2 is, when making a movement, positioned under the stationary panel 4. A plurality of indicating windows (apertures) 5 are provided in the stationary panel 4. More specifically, when the carrier 2 comes to a predetermined position under the stationary panel 4, the indicating windows 5 are arranged in a plurality of lines in the moving direction so that the LEDs 1*a*–1*c* can be seen through the indicating windows 5.

Figure 2:
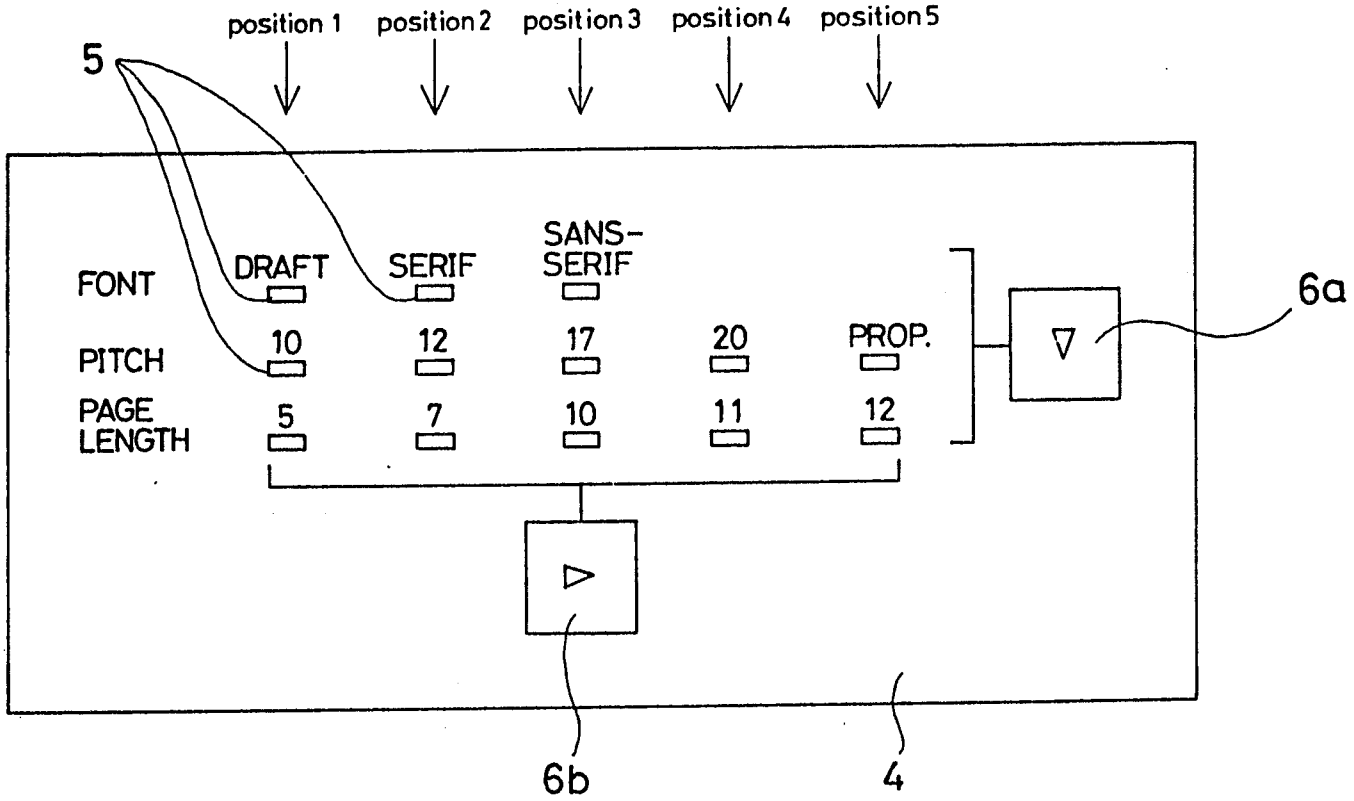
FIG. 2 is a plan view illustrating an operating panel.

Indicated on the stationary panel 4 are printing modes such as [DRAFT], [SERIF], [10], [12], . . . in respective display modes shown in the individual windows 5. When the carrier 2 comes to position 1 of FIG. 2, the LEDs 1*a*–1*c* are positioned just under the windows 5 disposed in the vicinities of indications such as [DRAFT], [10], [5]. When, e.g., the LED 1*a* is lit up at this moment, it follows that the window 5 close to the indication [DRAFT] is flashed. The situation is the same with the LEDs 1*b*, 1*c*, Similarly, when the carrier 2 is in a position 2, the windows 5 corresponding to the indications [SERIF], [12], [7] are flashed. This is the same with the positions 3–5.

A switch 6*a* serves to change over the display modes. A switch (operating switch) 6*b* serves to change over the printing modes. Marked positions of the respective printing modes on the operation panel in the carrier moving direction are sequentially set such as position 1, position 2, . . . , position 5.

Figure 3:
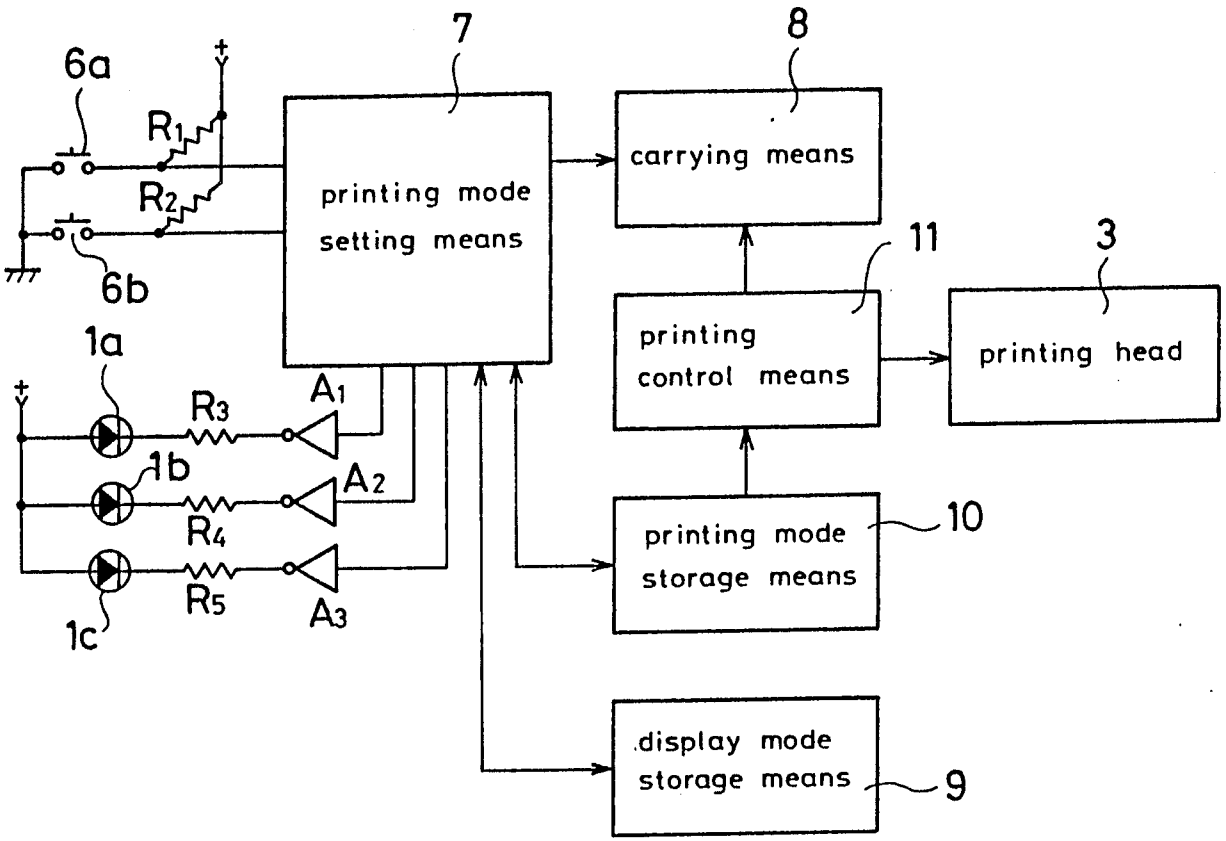
FIG. 3 is a circuit block diagram.
Figure 4:
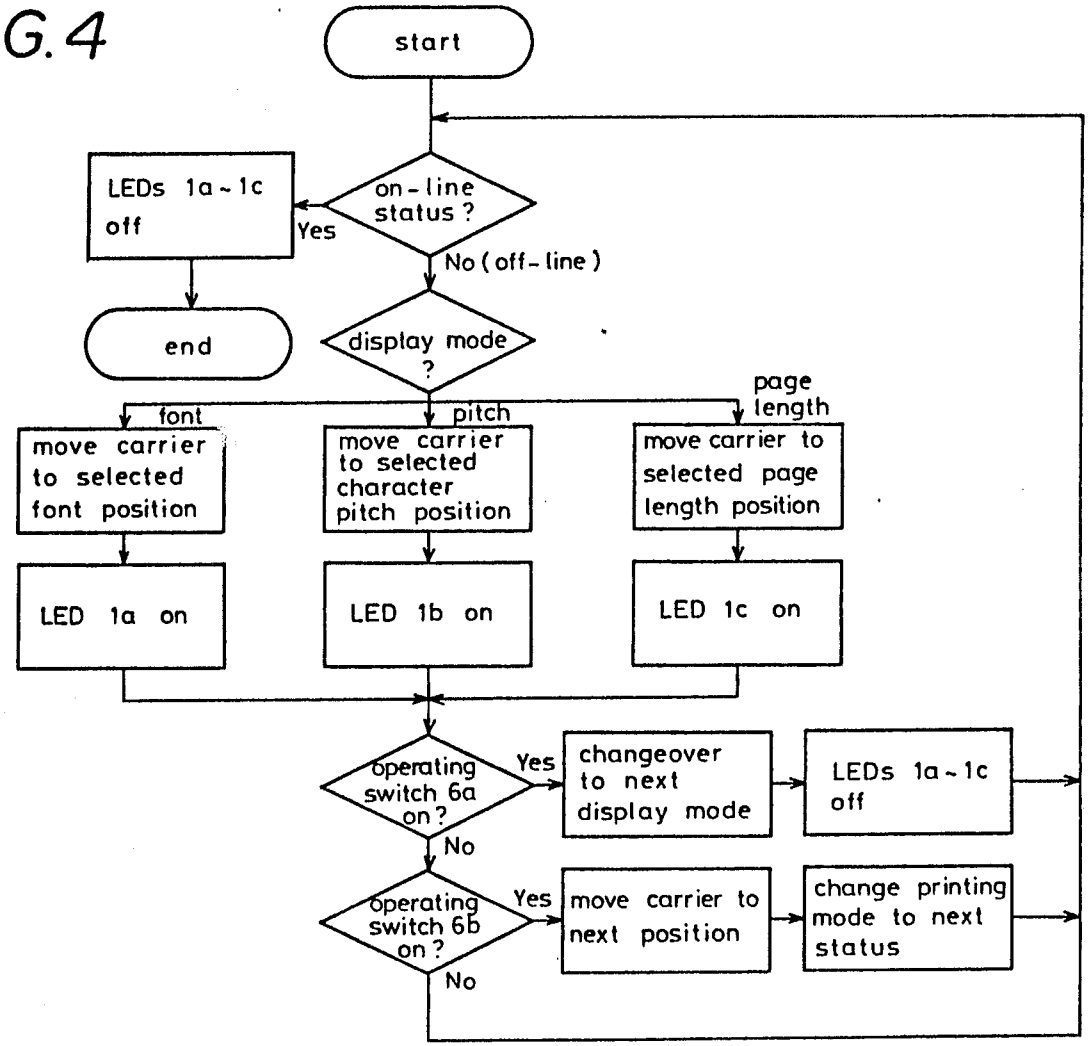
FIG. 4 is a flowchart of assistance in explaining an operation to set a printing mode.

FIG. 3 is a functional block diagram in this embodiment. FIG. 4 is a flowchart showing the operation of a printing mode setting means 7. Stored in a display mode storage means 9 is a present display mode, i.e., any one of [FONT], [PITCH] and [PAGE LENGTH]. A printing mode storage means 10 stores the information indicating which printing mode to be set for each of [FONT], [PITCH] and [PAGE LENGTH].

Next, the operation will be explained with reference to FIGS. 1 through 4. As is obvious from FIG. 4, when a printer is in an on-line status, the LEDs 1a–1c are merely extinguished, and no other operation is performed. The following is a description of a case in which the printer is in an off-line status. When the printer is brought into the off-line status, the content of the display mode storage means 9 is at first examined by the printing mode setting means 7. Now, supposing that the content is [FONT], the printing mode setting means 7 next checks which mode to be set for [FONT] among the contents of the printing mode storage means 10. It is now assumed that the content is [DRAFT]. The position 1 of FIG. 2 corresponds to [DRAFT], and hence the printing mode setting means 7 flashes the LED 1a after the carrier 2 has been moved to the position 1 by a carrying means 8. As a result, the window in the position of [DRAFT] appears bright to the user. It can be recognized that a mode of [DRAFT] is set with respect to [FONT].

The user depresses the switches 6a, 6b in the manner described below. The display mode and the printing mode are set while observing the indications of the printing modes and display modes corresponding to the respective windows on the stationary panel.

To start with, the printing mode setting means 7 checks whether the switch 6a is depressed or not. It is now assumed that the switch 6a is not depressed. The printing mode setting means 7 subsequently examines whether the switch 6b is depressed or not. At this moment, if the switch 6b turns out to be depressed, the carrier 2 is carried to the next position, viz., the position 2. Therefore, though the window in the position of [DRAFT] has appeared bright so far, the window in the position of [SERIF] is flashed at this time. The user is informed of the fact that the set content of [FONT] is changed to the next status, i.e., [SERIF]. Among the contents of the printing mode storage means 10, the set content of [FONT] is changed to the next status, viz., [SERIF].

Upon depressing the switch 6b once again, the position of [SANSSERIF] is similarly flashed. [SANSSERIF] is then set. Upon further depressing the switch 6b, [DRAFT] is set. In this manner, [FONT], i.e., the font styles are selected.

Next, supposing that the switch 6a is depressed, as illustrated in FIG. 4, the display mode is changed over to the next mode. To be specific, the content of the display mode storage means 9 is changed from [FONT] to [PITCH]. Then, the LEDs 1a–1c are extinguished. It is now presumed that the set content of [PITCH] is [12], viz., a character pitch of 12 CPI (Character Per Inch). In the same way with [FONT], the carrier 2 is moved to the position 2, and the LED 1b is lit up. Consequently, portion [12] in [PITCH] appears bright. Every time the switch 6b is depressed, the carrier 2 is in the same manner as above moved to the positions 3, 4, 5, 1 . . . Setting of the character pitch also changes such as 17 CPI, 20 CPI, PROPORTIONAL ([PROP.] represents a proportional print), 10 CPI . . . The character pitches are thus selectable.

Furthermore, when depressing the switch 6a once again, there comes [PAGE LENGTH], i.e., a status for setting a length of one page. The inches of one page are selectively set among 5, 7, 10, 11, 12. At this time, when further depressing the switch 6a, [FONT] can be set again.

In the manner discussed above, the font styles ([FONT]), the character pitches ([PITCH]) and the page lengths ([PAGE LENGTH]) can be manually set.

Note that in this embodiment the display means mounted on the carrier 2 involves the use of the LEDs, however, display means other than this are usable. For example, a seal assuming a fluorescent color or coating is so applied to the carrier 2 as to be visible through the windows 5. In this case, the windows 5 are arranged obliquely, or alternatively the foregoing fluorescent color portions are set obliquely. With this arrangement, the fluorescent color portion can be seen through only one of the windows 5 depending on the position of the carrier 2.

In accordance with this embodiment, the three modes such as [FONT], [PITCH] and [PAGE LENGTH] are selectable. The number of the selectable modes is not limited to this but may be 1. Besides, the types and the number of printing modes are not limited to those described in this embodiment.

Note that the stationary panel is not limited to the one encased in the printer case as in this embodiment but may be provided in a part of the printer. Moreover, the switches 6a, 6b may not be provided on the stationary panel but may be provided in other portions of the printer.

As discussed above, the set contents are displayed on the stationary panel when setting the printing modes according to the present invention. The moving quantity of the visual line is even smaller than by the conventional method in which the user identifies the set contents by seeing the position itself of the printing head. The operability is enhanced. In a comparison with the method in which the LEDs corresponding to the number of set contents are employed, a still less number of the LEDS, drive circuits and ports for transmitting the signals for driving may suffice. Therefore, the device can be constructed at low costs.

As explained above, the present invention is capable of providing the printing mode setting method exhibiting a high operability at low costs.

Although the illustrative embodiment of the present invention has been described in detail with reference to the accompanying drawings, it is to be understood that the present invention is not limited to this embodiment. Various changes or modifications may be effected therein by one skilled in the art without departing from the scope or spirit of the invention.

What I claim is:

1. A serial printer comprising:

a moveable carrier and a printing head mounted on said carrier;

a display means attached to and moveable with said carrier;

a stationary panel formed with a plurality of indicating windows arranged in a plurality of lines extending in a moving direction of said carrier so that said display means is visible through a specific indicating window when said carrier is disposed in a predetermined position;

a carrying means for moving said carrier;

a printing mode storage means for storing printing modes;

an operating switch for selecting said printing modes; and a printing mode setting means for causing said carrying means to selectively move said carrier to said predetermined position in response to operation of said operating switch and changing said printing mode stored in said printing mode storage means in accordance with the position of said carrier.

2. A serial printer according to claim 1, wherein said plurality of indicating windows are disposed in said stationary panel in a direction orthogonal to the moving direction of said carrier.

3. A serial printer according to claim 1, wherein a plurality of said display means are provided in correspondence with a plurality of display modes and further comprising a display mode storage means for storing said plurality of display modes.

4. A serial printer according to claim 3, further comprising a display mode selecting switch mounted on said panel, for selecting said display modes.

5. A serial printer comprising a moveable carrier means mounting a printing head, a display means attached to and moveable with said carrier, a stationary panel having a plurality of indicating windows, said windows selectively corresponding to various selectable printing modes, said display means being selectively visible through said windows at predetermined positions of said carrier, a printing mode storage means, and a printing mode setting means for effecting movement of said carrier means to a position in which said display means is disposed in display relationship with a selected window and for changing the printing mode set in said printing mode storage means to correspond to the selected printing mode associated with said selected window.

6. A serial printer according to claim 5, wherein said plurality of windows are disposed in a plurality of rows parallel to the direction of movement of said carrier means.

7. A serial printer according to claim 6, wherein said display means comprises a plurality of display elements arranged such that only one display element is visible through each row of windows.

8. A serial printer according to claim 7 further comprising a display mode selecting switch for selectively effecting display of one of said plurality of display elements.

9. A serial printer according to claim 5, wherein said plurality of windows are disposed in spaced linear array parallel to the direction of movement of said carrier means.

10. A serial printer according to claim 5, wherein at least some of said windows are linearly aligned in a direction transverse to the direction of movement of said carrier means.

11. A serial printer according to claim 5, wherein said printing mode setting means comprises manually operated means operable to control movement of said carrier means to a plurality of positions in which said display means is disposed in displayable relationship with selected windows.

12. A serial printer according to claim 11, wherein said manually operated means comprises a first switch means operable to control movement of said carrier to said plurality of positions and second switch means operable to activate said display means such that the activated display means is in display relationship with said selected windows.

13. A serial printer according to claim 12, wherein said display means comprises a plurality of display elements, said second switch means being operable to selectively activate said plurality of display elements.

14. A serial printer according to claim 5, wherein said printing mode storage means comprises means for storing variable font printing modes.

15. A serial printer according to claim 7, wherein said printing mode storage means comprises means for storing variable pitch printing modes.

16. A serial printer according to claim 5, wherein said printing mode storage means comprises means for storing variable page length printing modes.

* * * * *